US005346296A

United States Patent [19]

Kelley

[11] Patent Number: 5,346,296

[45] Date of Patent: Sep. 13, 1994

[54] ASSEMBLY OF WALL UNITS WITH CONCEALED WIRE STORAGE

[75] Inventor: James O. Kelley, Spring Lake, Mich.

[73] Assignee: Sligh Furniture Co., Holland, Mich.

[21] Appl. No.: 36,193

[22] Filed: Mar. 23, 1993

Related U.S. Application Data

[63] Continuation of Ser. No. 770,015, Sep. 30, 1991, abandoned, which is a continuation of Ser. No. 505,555, Apr. 6, 1990, abandoned.

[51] Int. Cl.[5] ..... A47B 53/00

[52] U.S. Cl. ..... 312/198; 312/265.6

[58] Field of Search ..... 312/111, 198, 265.6, 312/265.5, 7.1, 195

[56] References Cited

U.S. PATENT DOCUMENTS

| | | | |
|---|---|---|---|
| 3,351,400 | 11/1967 | Sholtes | 312/111 |
| 3,851,936 | 2/1974 | Muller | 312/111 |
| 3,883,202 | 5/1975 | Konig | 312/195 |
| 4,050,752 | 9/1977 | Dykstra | 312/195 |
| 4,066,305 | 1/1978 | Gazarek | 312/195 |
| 4,461,519 | 7/1984 | Hildebrandt et al. | 312/265.6 |
| 4,828,340 | 5/1989 | Jorgensen | 312/7.1 |

*Primary Examiner*—Kenneth J. Dorner
*Assistant Examiner*—Gerald A. Anderson
*Attorney, Agent, or Firm*—Waters & Morse

[57] ABSTRACT

A group of cabinet modules can be lined up side-by-side against a wall with space between the modules, and between them and the wall, to provide communicating passages for receiving concealed wiring. Pilasters cover these spaces, and also spaces between the outer modules and end panels. A slip-in fastening system for the pilasters facilitates the installation and maintenance of the wiring. This system can also be incorporated in a free-standing space divider by assembling a group of units back-to-back.

8 Claims, 7 Drawing Sheets

FIG. 8
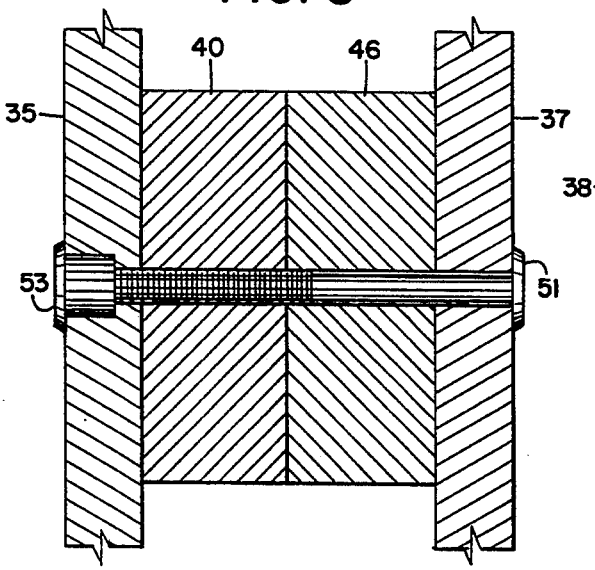
FIG. 10
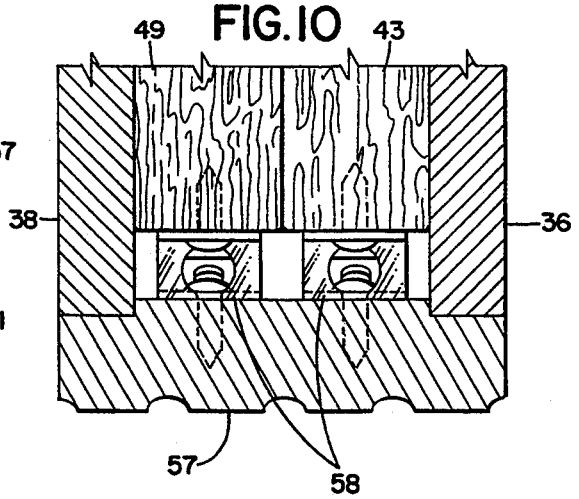
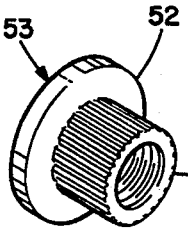
FIG. 9
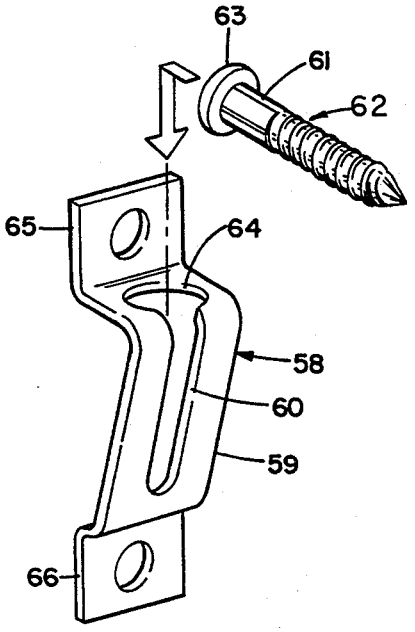
FIG. 11
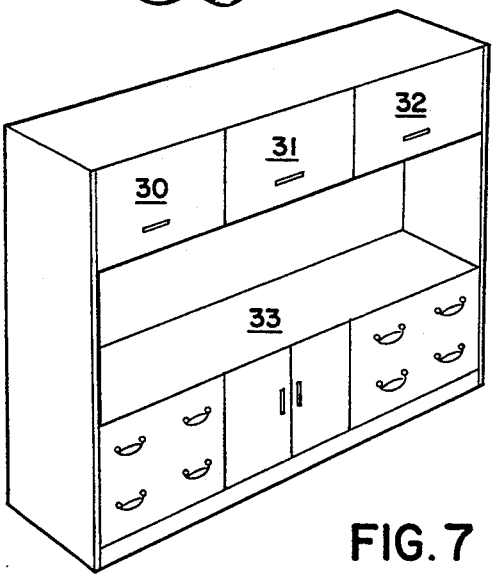
FIG. 7

ASSEMBLY OF WALL UNITS WITH CONCEALED WIRE STORAGE

CROSS REFERENCE TO RELATED APPLICATIONS

This is a continuation of application Ser. No. 07/770,015, filed Sep. 30, 1991, which is a continuation of application Ser. No. 505,555, filed Apr. 6, 1990, both abandoned.

BACKGROUND OF THE INVENTION

The attractiveness and utility of built-in cabinet furniture along a wall is often out of reach because of the cost of site-built construction. Factory manufacture of modular components reduces the cost factor, but tends to produce installations that do not have the finished integral look of custom installations. If the appearance problem can be solved, and provision made for the installation of concealed wiring, a wide variety of units can be grouped into a very useful and attractive assembly, while preserving the quality of factory-constructed cabinet work. Bookshelves, desks, drawer units, and cabinets with swinging or sliding doors are general examples of an endless variety of units that can be interrelated in this way.

SUMMARY OF THE INVENTION

An assortment of cabinet and related modules is lined up in spaced side-by-side relationship, normally backed up against a wall. The group is also spaced from the wall, except at the end panels, with the spaces between the modules, and between them and the wall, being adapted to receive wiring. The opposite ends of the group are closed off either by an end panel or an adjacent wall in spaced relationship to the end modules. Pilasters are provided over the spaces between the modules, and between the modules and the end panels. Preferably, the pilasters are held in position by slip-in fasteners.

DESCRIPTION OF THE DRAWINGS

FIG. 7 illustrates a "triple wide" unit combining several standard features of cabinet furniture.

FIG. 8 is a fragmentary section on a horizontal plane showing the interconnection between an end panel and the adjacent cabinet unit.

FIG. 9 is a perspective view of a standard fastener used in conjunction with the fastening illustrated in FIG. 8.

FIG. 10 is a fragmentary section on a horizontal plane showing the retention of a pilaster strip between adjacent units.

FIG. 11 is a perspective view of a standard slip-in fastener that is usable in conjunction with the assembly shown in FIG. 10.

DESCRIPTION OF THE PREFERRED EMBODIMENTS

Figure 1:
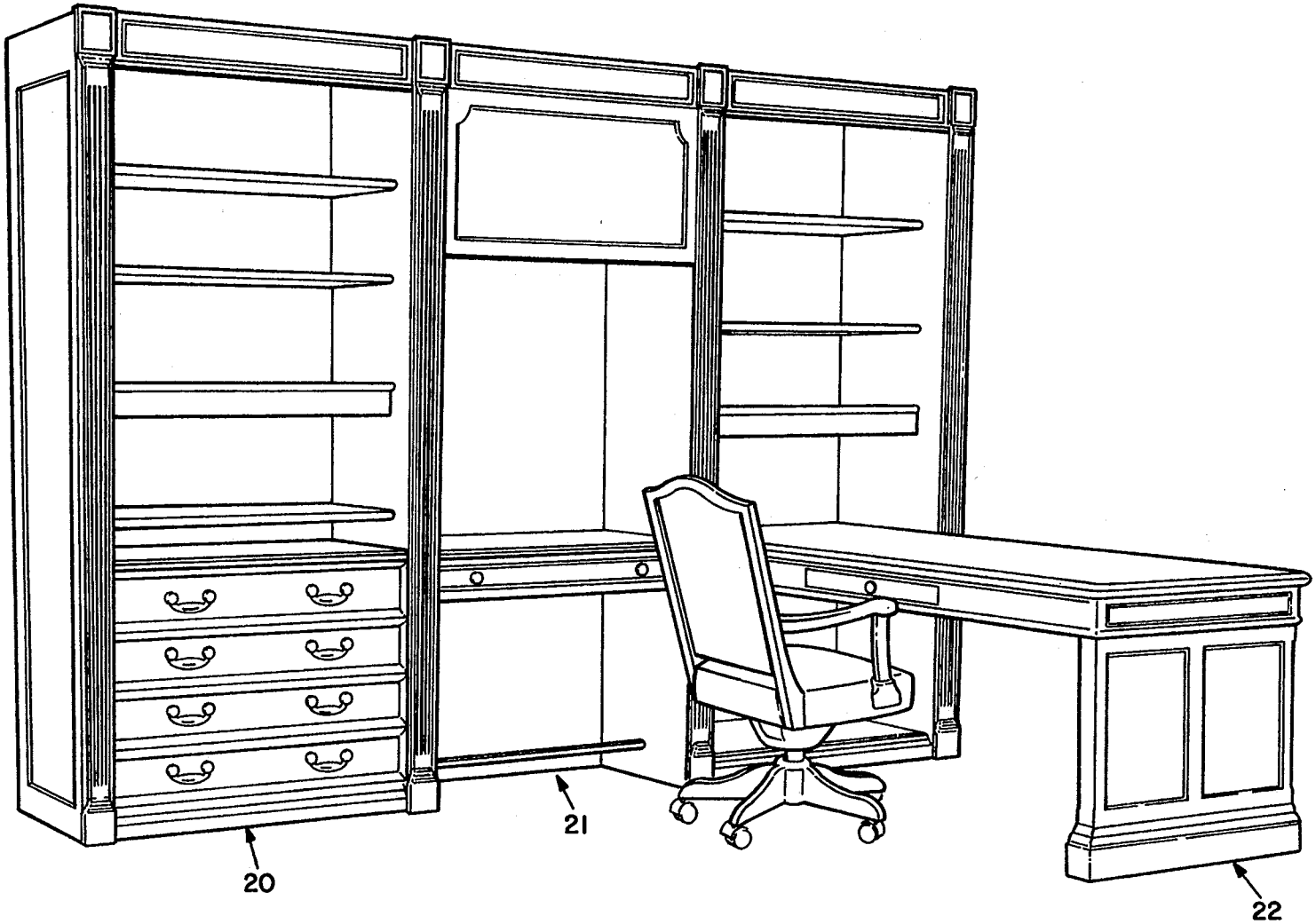
FIG. 1 is a perspective view of a typical group of the sort of modular units that can be interrelated according to the present invention.
Figure 6:
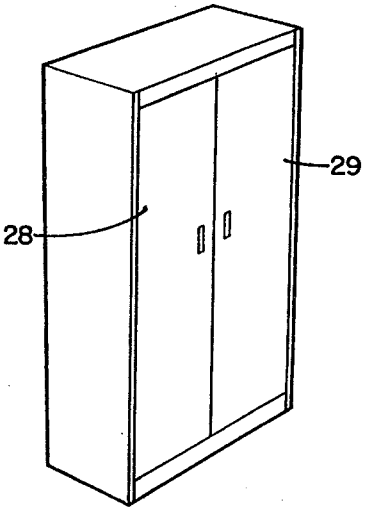
FIG. 6 shows a perspective view of a cabinet that can be used as a wardrobe.
Figure 5:
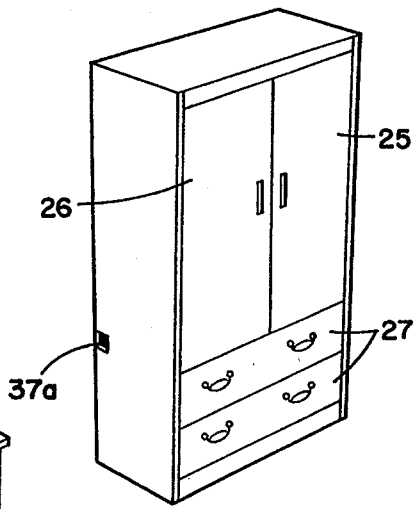
FIG. 5 is a perspective view of a module providing an upper cabinet and two lower drawers.
Figure 4:
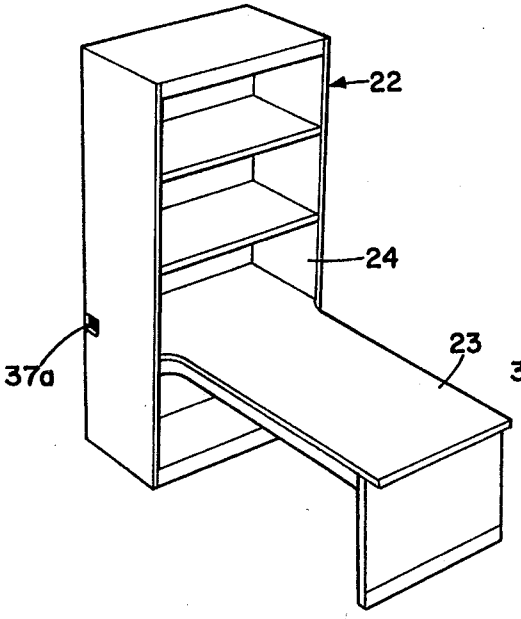
FIG. 4 shows a perspective view of a module that includes a desk and a shelving section.

Referring to FIG. 1, the modules 20, 21 and 22 are shown grouped together in a typical office installation. Unit 20 combines lower drawers with an upper shelving section. These units function as a work station along with the desk section 22, providing accommodation for computers and other equipment. Additional shelving is provided at the side, and above the surface of the desk. The unit 22 is shown somewhat schematically in FIG. 4. The desk 23 extends into the shelving section 24, preferably at the level of one of the shelves. In FIG. 5, the upper cabinet section is closed by the swinging doors 25 and 26, and the lower section is occupied by the drawers 27. In FIG. 6, the entire interior of the unit is made accessible for use as a wardrobe by the swinging doors 28 and 29. In FIG. 7, the "triple wide" unit provides the upper spaces concealed by the hinged doors 30–32, and a long counter 33 extends above the pairs of drawers at the opposite sides of the unit and the central storage cabinet.

Figure 2:
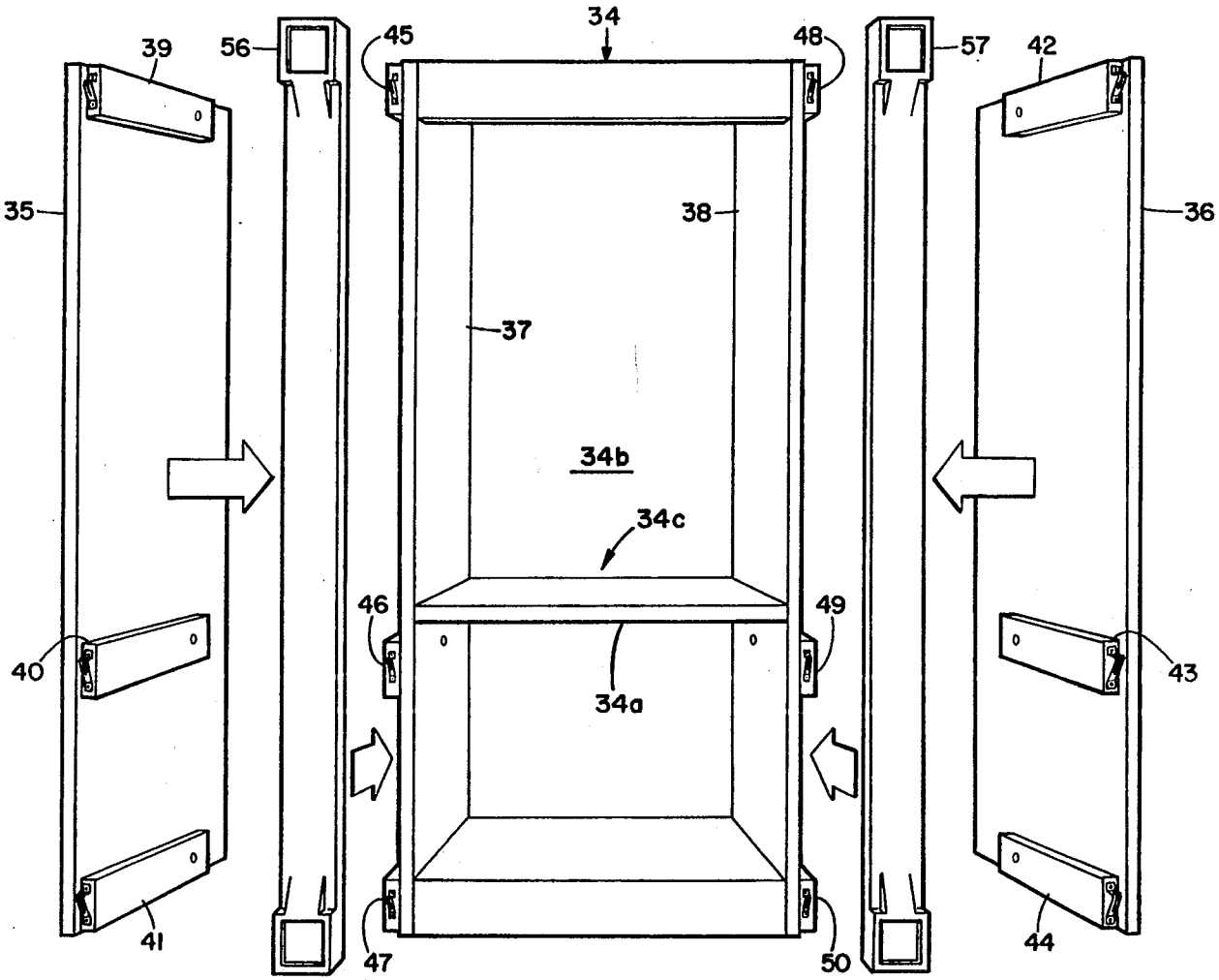
FIG. 2 shows an exploded view of the components of a typical module.
Figure 3:
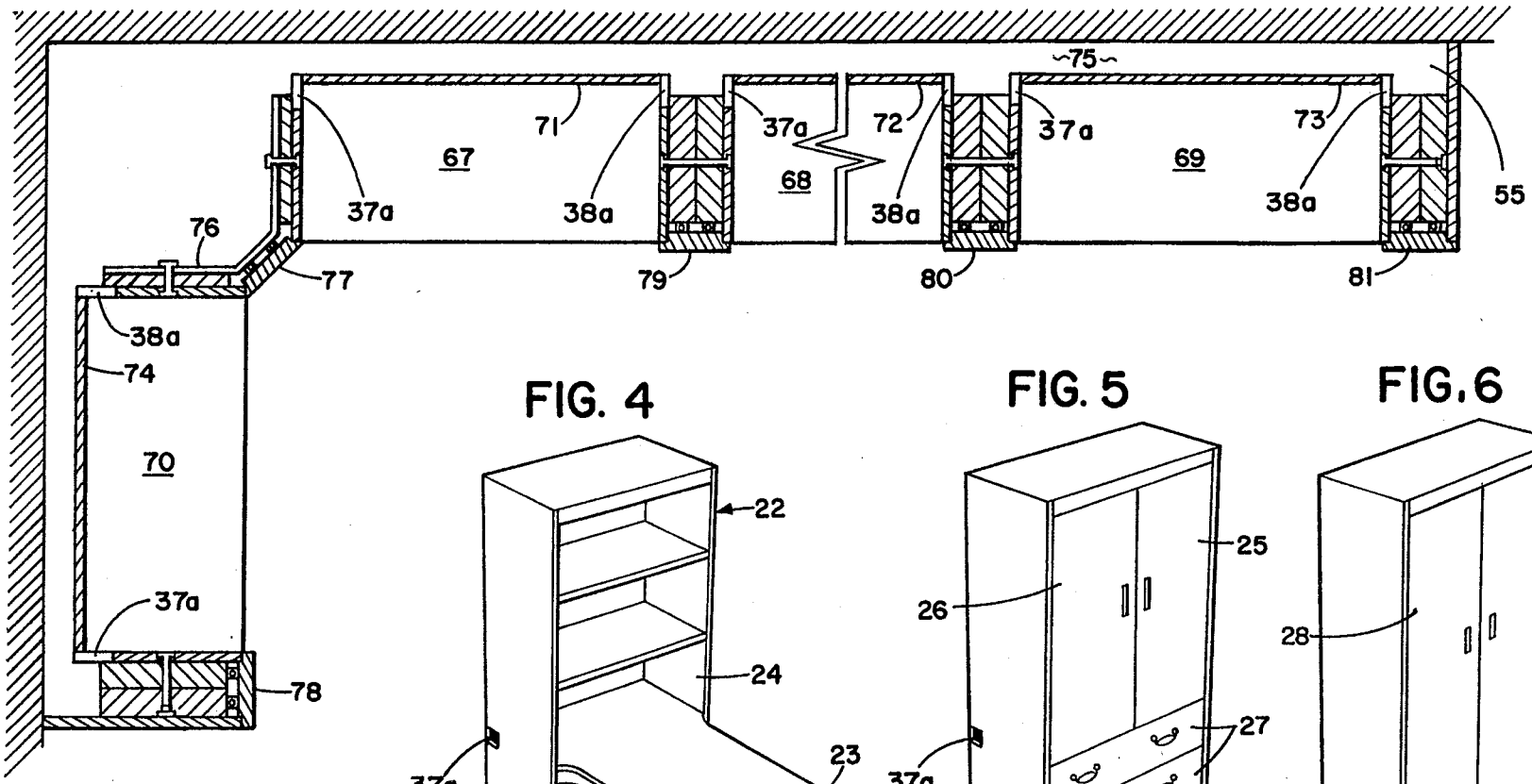
FIG. 3 is a sectional view on a horizontal plane showing a typical arrangement of modules at a wall intersection.

The structure of typical units is illustrated in FIGS. 2 and 3. The central portion of the unit 34 may provide any of the arrangements previously referred to. End panels as shown at 35 and 36 can be applied at either side of the unit 34. A spaced relationship between the end panels and the side panels 37 and 38 of the unit 34 is maintained by the spacer boards 39–44 on the inside of the end panels, and the opposite spacer boards 45–50 on the outside of the panels 37 and 38. Securing of the units together is accomplished with the fastening arrangement shown in FIG. 8. The spacer boards are screwed or bonded to the interior surfaces of the end panels and the exterior surfaces of the side panels of the individual units. Aligned holes are provided that traverse the panels and the spacer boards. These holes are preferably drilled to receive the screw 51; and counterbored at one end to receive the body portion 54 of the nut 53 provided with internal threading. This special nut is also usually provided with an Allen recess, or it may be adapted to be forced into the hole with a non-rotative engagement. When an end panel is secured to the side panel of one of the units, the fastening system shown in FIG. 8 does not traverse the end panel. The nut 53 is set with its head flush with the spacer board on the end panel prior to the attachment of the spacer board to the end panel.

The spaced relationship established by the spacing boards and the fastenings provides a passage as shown at 55 (See FIG. 3) for the installation of wires or small pieces of equipment that may be associated with the units. The pilasters 56 and 57 (See FIG. 2) are then slipped into place with a fastening system that permits them to be removed easily for access to this space. A typical form of such a slip-in fastening is illustrated in FIG. 11. The receptacle 58 is bent from spring steel to provide a ramp 59 with a slot 60 wide enough to receive the body portion 61 of the shoulder screw 62. The head 63 of this screw is receivable in the enlarged opening 64 at the end of the slot 60. The unit 58 can be installed on the ends of the spacer boards, and the screw 62 is engaged with the inside surface of the pilasters. The foot portions 65 and 66 of the receptacle receive conventional screw fastenings. It should be noted that the rabbets along the edges of the pilasters permit the pilasters to partially enter into the space between the side and end panels, and provide a stop to the degree of this entrance. This appears best in FIG. 10. The pilaster is installed by elevating it slightly above its anticipated final position, and pushing it downward into place far enough for the heads 63 of the shoulder screws to enter into the openings 64 in the receptacles 58. The pilaster is then lowered so that the head 63 will be riding down the slot 60 of the ramp 59, and tightening the pilaster against the front edges of the panels. The proper degree of tightening is controllable by the adjustment of the shoulder screw 62, which can be screwed into the material of the pilaster slightly to cause it to engage the ramp 59 somewhat sooner. This adjustment should be made not more than a quarter of a turn at a time. The ends of the spacer boards are terminated short of the edges of the panels, as shown in FIG. 10, to provide for this fastening system.

In addition to the spaces between the units, and between the units and the end panels, space is also provided between the rear of the units and the adjacent wall against which they are placed. Referring to FIG. 3, the units 67–70 are shown lined up at a corner junction of two walls. The units are held together in spaced relationship, and secured as previously described. The side panels of each of the units terminate at the rear closure panels 71–74 of the units to establish the space 75 for the reception of wires that may have to be located in that area. Extension of wires to and from this space, and the spaces between the units, is provided for by slots or other openings as shown at 37*a* and 38*a* in FIG. 3. This space communicates with the spaces between the units, and with the spaces adjacent its end panels. Fixed shelves, as shown at 34*a* in FIG. 2 terminate in front of the rear panel 34*b* as shown at 34*c* to provide a gap for receiving wires. The communicating space extends across the corner area, as shown, where the units 67 and 70 may be interconnected by a piece of bent sheet metal as shown at 76, which is covered by another pilaster 77. This is preferably similar in appearance to the other pilasters 78–81.

Figure 12:
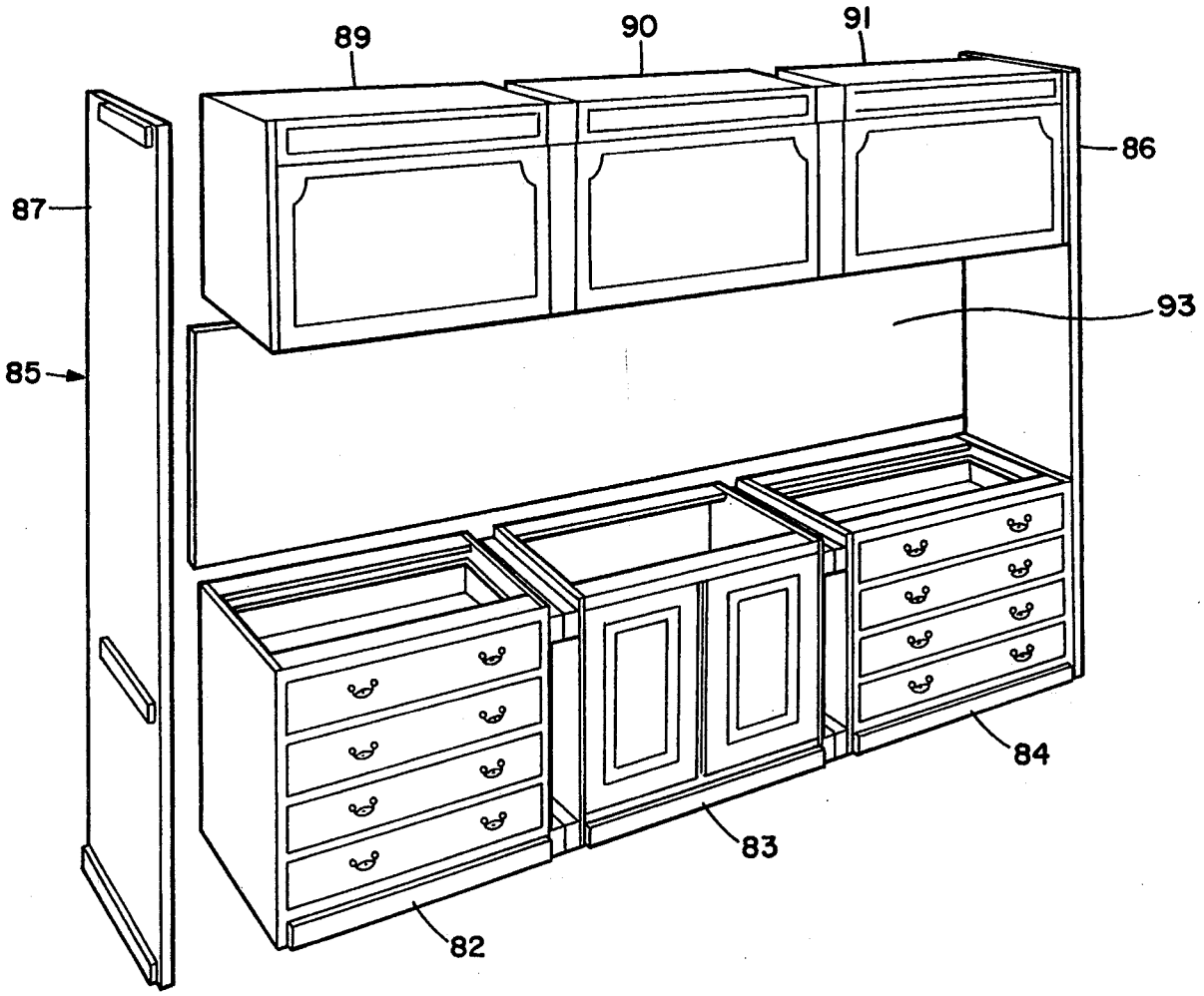
FIG. 12 is a partially exploded view of a "triple wide" wall unit.
Figure 13:
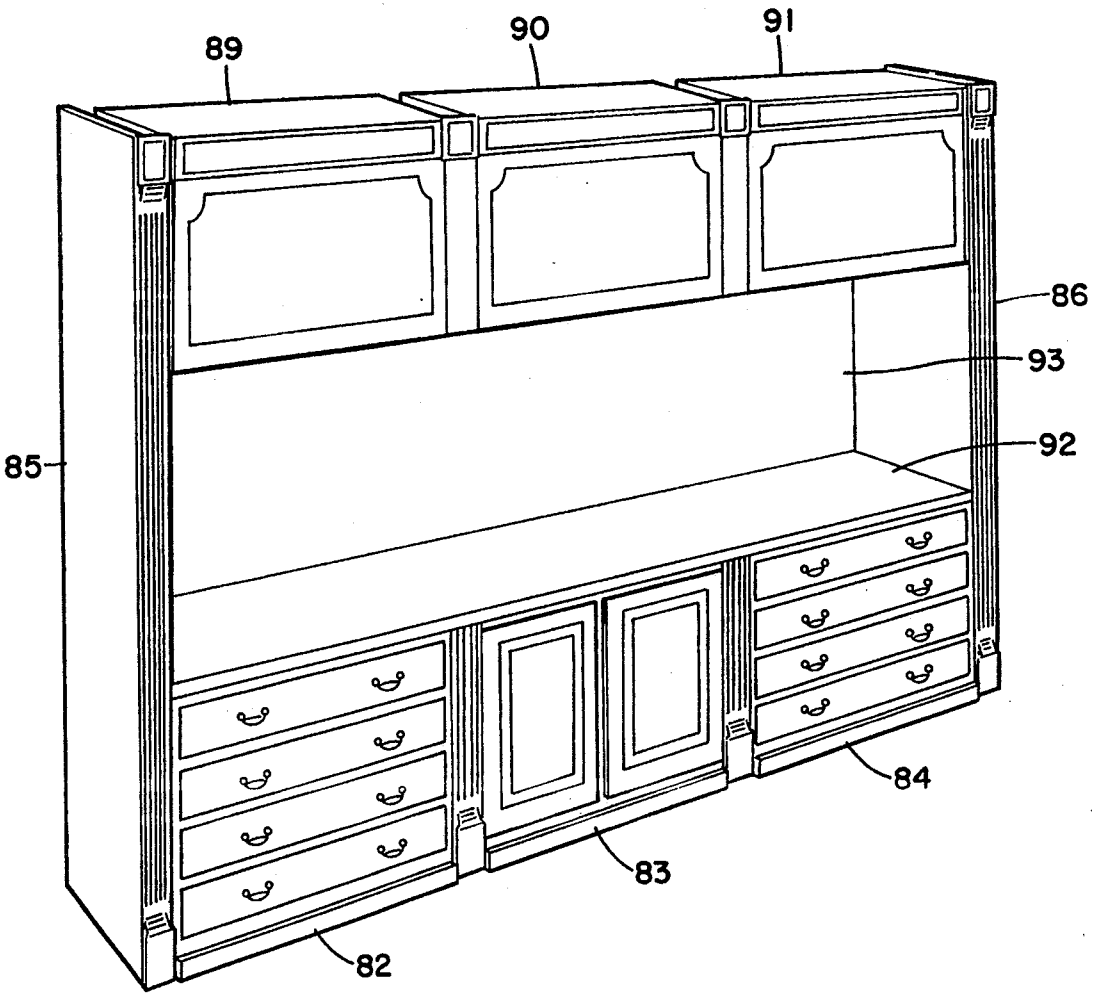
FIG. 13 illustrates the fully assembled condition of the unit shown in FIG. 13.

Referring to FIGS. 12 and 13, a "triple wide" unit is assembled together so that it can be installed against a wall as an integral unit. The lower modules 82, 83, and 84 are first bolted together with fastenings of the type shown in FIG. 8. Spacer panels 85 and 86 are then secured to the ends of the group of lower units without spaces between the panels and these units. The spacer panels each extend the full height of the assembly. The upper cabinet units 89–91 are bolted together with intervening spaces and pilasters, as are the lower units. The spacer panels are bolted to the ends of the assembly of the upper and lower units.

The next step in the assembly is illustrated in FIG. 13. The counter top 92 is placed on top of the lower units, and slid back into position, where it can be secured with ordinary screws to the structure of the lower units. The final step is the installation of the rear closure panel 93, which defines the rear of the space between the upper and lower units. This is also secured in place with ordinary screws. This panel 93 will be spaced from the wall against which the complete assembly is placed, to provide for the continuity of the space reserved for the installation of wiring. The rear panel 93 is screwed into the back edges of panels 85 and 86, and to the backs of 89, 90, and 91. Prior to installation, the panel 93 may be covered with fabric, or left with a wood grain finish.

Figures 14, 15:
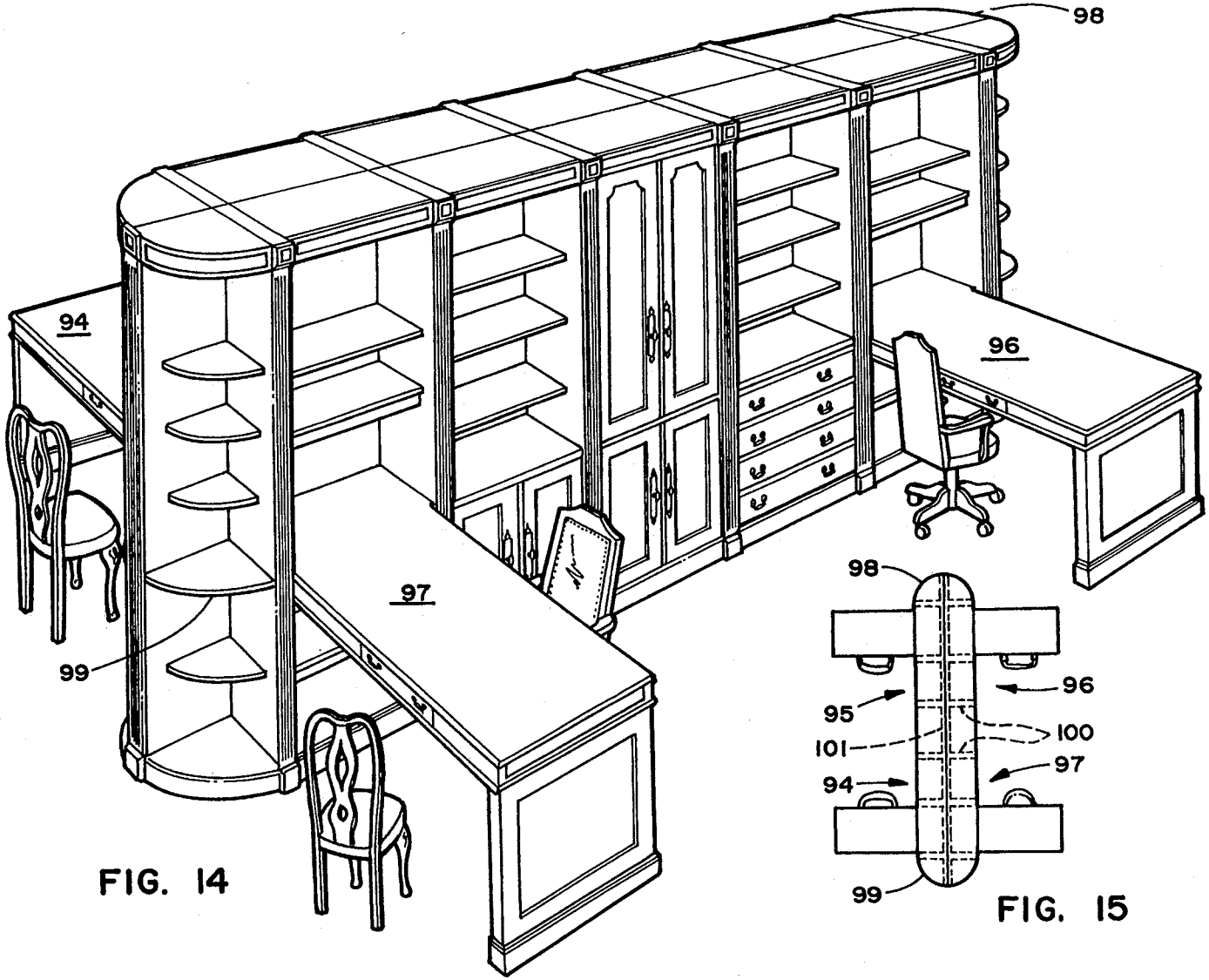
FIG. 14 is a perspective view of a free-standing interconnected group of units.
FIG. 15 is a schematic plan view of the group shown in FIG. 14.

Referring to FIGS. 14 and 15, the system for providing concealed wiring space is also applicable to a free-standing unit isolated from a wall to function as a space divider. The work stations 94–97 are secured together back-to-back, and rounded shelving sections as shown at 98 and 99 are added to produce the illustrated configuration. The communicating interior spaces 100 and 101 are formed as previously described, and closed by pilasters.

I claim:

1. A free standing furniture unit particularly suited for placement against a wall or back to back against like furniture units comprising:

one or more modules connected together in edge to edge fashion, each module having a front, back and sides, the sides comprising a pair of spaced vertical side panels, a rear panel extending between the side panels and enclosing the back of the module, components selected from the group consisting of shelves, cabinets, drawers and work surfaces being mounted between the side panels, the unit further comprising end panels mounted on outer surfaces of the side panels at exposed ends of the furniture unit, the end panels covering the side panels and extending rearwardly past rear edges of the side panels and the rear panels of the modules, such that when the furniture unit is placed against a wall, rear edges of the end panels can abut the wall so as to create the impression of a built-in furniture unit, while the rear panels and rear edges of the side panels are spaced away from the wall, the spacing being sufficient that electrical wiring and connectors can fit behind the unit and can extend in a completely concealed fashion from module to module between end panels at opposite ends of the furniture unit.

2. A furniture unit according to claim 1, wherein the end panels are spaced from the adjacent side panels by spacers that provide wiring communication between the end and side panels from the front of the furniture unit to the space behind the unit, such that wiring can extend behind the modules and then outwardly between the end panels and adjacent side panels, the furniture unit further comprising pilasters removably mounted over outer edges of the end panels and adjacent side panels and covering the space therebetween, the pilasters being removably mounted on the furniture units such that they can be manually removed without disassembling the unit in order to provide wiring access to the space behind the pilasters.

3. A furniture unit designed for placement against a wall or back to back against a like furniture unit and comprising one or more furniture modules connected together in edge to edge relationship, each module comprising spaced vertical side panels and a rear panel extending between the side panels to form a back of the module, with shelves, cabinets, drawers, or work surfaces mounted between the side panels, the improvement comprising end panels mounted on the side panels of the module at exposed ends of the unit, spacers being positioned between the end panels and side panels to form a wire access space between the end and side panels that is sufficiently wide for a person to reach between the panels to pass wiring therebetween, the end panel extending rearwardly past the back of the unit, such that when the unit is positioned with the end panels flush against a wall, the rear panels and side panels are spaced forwardly of the walls, leaving a concealed space behind the unit for wire storage and passage, the extension of the end panels past the back of the unit also facilitating flush mounting of the unit against the wall and providing the appearance of a built-in unit without requiring a flush fit of the entire unit back with the wall.

4. A furniture unit according to claim 1, wherein the unit comprises an edge-to-edge assembly of two or more separate modules, each with its own side panels and with end panels at exposed ends of the assembly, the assembly including a spacer between adjacent side panels of adjoining modules, the spacer separating the side panels a predetermined distance sufficient to create a wire access space therebetween that permits the passage of electrical wires and connectors and communication cables between the adjacent side panels as well as along the back of the unit between adjacent modules.

5. A furniture unit according to claim 4 and further comprising opening means in the side panels for permitting electrical wiring to be extended through the side panels from the space between adjacent side panels into the interior of the unit on a front side of the rear panel.

6. A free standing furniture unit according to claim 4 and further comprising removable pilasters covering the wiring access spacers, the pilasters being held in place by manually releasable fasteners.

7. A furniture unit according to claim 6, wherein the releasable fasteners for each pilaster comprises one member mounted on a module and another member mounted on the pilaster, the members being manually engageable from the front of the unit to hold the pilaster snugly on the furniture unit when the pilaster is positioned on the furniture unit, the members being completely concealed when the pilaster is mounted on the furniture unit, the fasteners being releasable from the front of the unit to permit removal of the pilaster by manual manipulation of the pilaster without requiring any tools.

8. A furniture unit according to claim 7, wherein the pilasters are mounted on the furniture unit by slide fit fasteners, wherein the pilasters are fitted against the furniture unit in an elevated position and are slid downwardly into a mounted position, the fasteners becoming engaged as a pilaster is slid downwardly to its mounted position, the fasteners drawing the pilaster snugly against the furniture unit as the pilaster is slid downwardly, the pilasters being removable by sliding the pilaster upwardly until the fasteners release and then pulling the pilasters away from the furniture unit.

* * * * *